United States Patent [19]

Ditto

[11] 4,257,342

[45] Mar. 24, 1981

[54] FIREPLACE DAMPER POSITION INDICATOR

[76] Inventor: Donald R. Ditto, Rte. #2, Box #60F2, Winnsboro, Tex. 75494

[21] Appl. No.: 969,466

[22] Filed: Dec. 14, 1978

[51] Int. Cl.[3] ..... G09F 7/18

[52] U.S. Cl. ..... 116/307; 40/600; 40/611; 40/616; 40/617; 116/277

[58] Field of Search ..... 40/428, 124, 600, 621, 40/617, 907, 616, 11 A, 606, 611, 124.1; D20/10, 21, 28, 42, 43; 126/288, 120; 116/277, 278, 306

[56] References Cited

U.S. PATENT DOCUMENTS

| | | | |
|---|---|---|---|
| 228,988 | 6/1880 | Dumars | 40/11 A |
| 874,998 | 12/1907 | Schumacher | 40/617 X |
| 1,898,379 | 2/1933 | Meehan | 40/616 X |
| 3,289,338 | 12/1966 | Stephens | 40/600 X |
| 3,708,897 | 1/1973 | Adams et al. | 40/617 X |
| 3,984,931 | 10/1976 | Belokin, Jr. | 40/600 X |
| 4,009,532 | 3/1977 | Thomas | 40/11 A |
| 4,015,587 | 4/1977 | Wincek | 126/288 X |

*Primary Examiner*—John F. Pitrelli
*Assistant Examiner*—G. Lee Skillington
*Attorney, Agent, or Firm*—Gerald G. Crutsinger; John F. Booth; Harry C. Post, III

[57] ABSTRACT

A fireplace damper position indicator for indicating whether the damper to the flue is open or closed to prevent building a fire with a closed damper or leaving the damper open allowing air to escape from the room. The device briefly is a magnetic holder to attach to the fireplace lintel and a hanger pivotally secured to the holder to connect to a sign. The sign has indicia indicating "open" on one side and "closed" on the other side such that when the fireplace damper is open the sign is turned to read "open" indicating the damper is open.

6 Claims, 10 Drawing Figures

FIREPLACE DAMPER POSITION INDICATOR

BACKGROUND

Fireplaces generally have a damper to open and close the flue since that when a fire is not burning in the fireplace the damper is closed preventing air from escaping out of the room. It is often difficult to determine whether a damper is open or closed without opening the screen and looking up the flue. Often a person will build a fire without realizing that the damper is closed and thus allowing smoke to escape into the room.

It would be desirable to have an easily attachable indicator which would show whether the damper was open or closed.

SUMMARY

I have devised a fireplace damper position indicator briefly comprising a magnetic attachment means and a U-shaped sign having embossed indicia to indicate open on one side and closed on the other. The sign is positionable on the lintel under the forward, upper portion of the fireplace opening such that it is disposed in easy view to indicate whether the damper is closed or open. Once the damper is moved to the open or closed position the position indicator is changed to reflect which position the damper is in.

The primary object of the invention is to provide a device which indicates whether the fireplace damper is open or closed.

Another object of the invention is to provide a device which is universally attachable to existing fireplaces as well as fireplaces constructed in the future.

A further object of the invention is to provide a device which indicates the position of the damper without interfering with the screen or other protected devices normally associated with fireplaces.

Other and further objects of the invention will become apparent upon studying the detailed description hereinafter following and the drawings annexed hereto.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
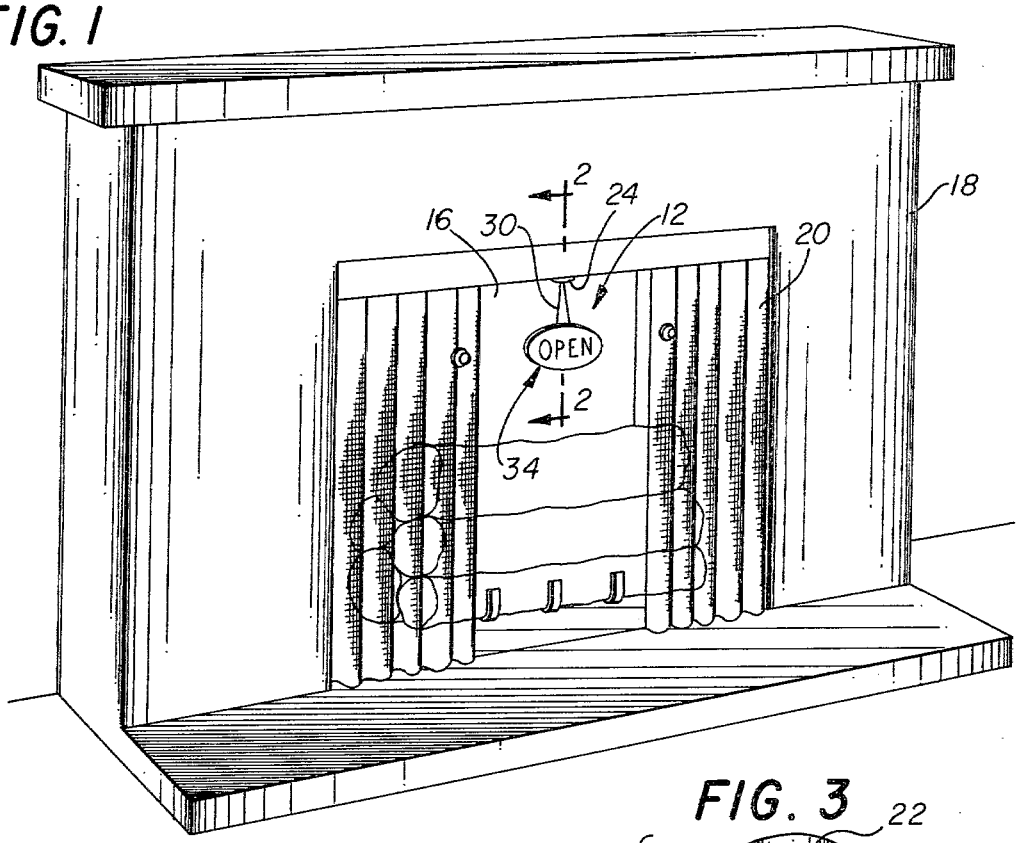
FIG. 1 is a perspective view of the position indicator and a typical fireplace.
Figure 2:
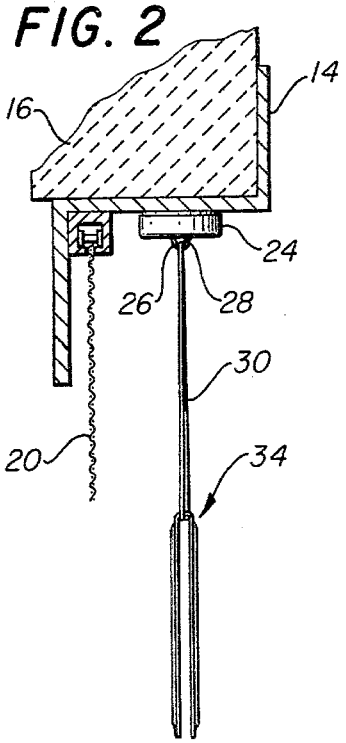
FIG. 2 is an enlarged cross-sectional view taken along line 2—2 of FIG. 1.
Figure 3:
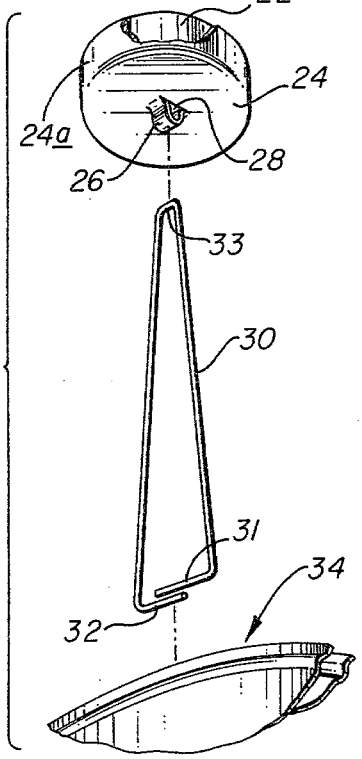
FIG. 3 is an exploded view of the magnetic holder and hanger and upper portion of the indicator.
Figure 5:
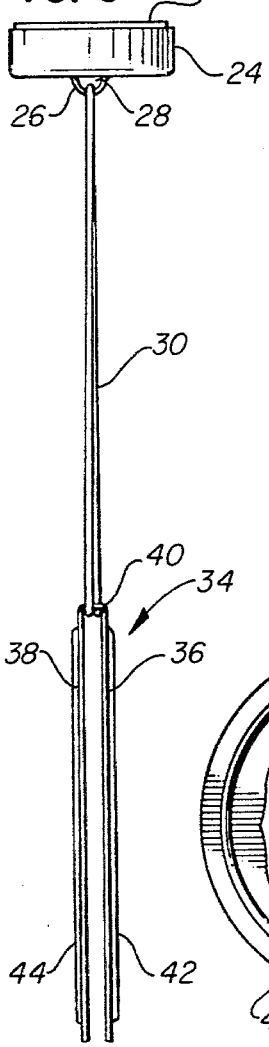
FIG. 5 is a left side elevational view thereof.
Figure 4:
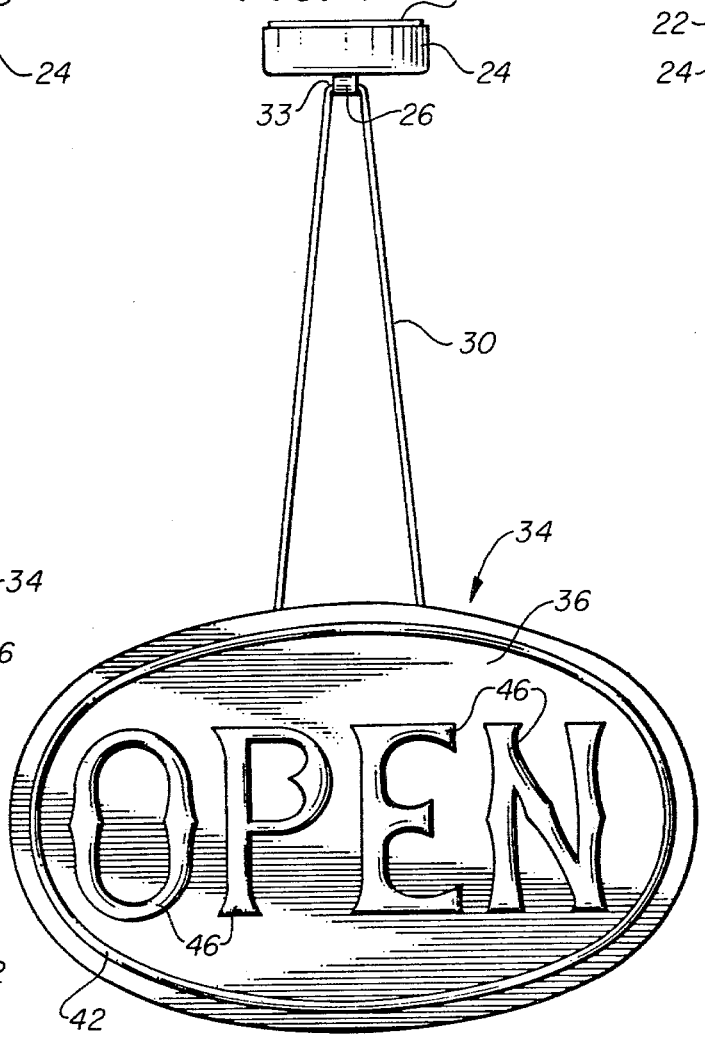
FIG. 4 is a front elevational view thereof.
Figure 6:
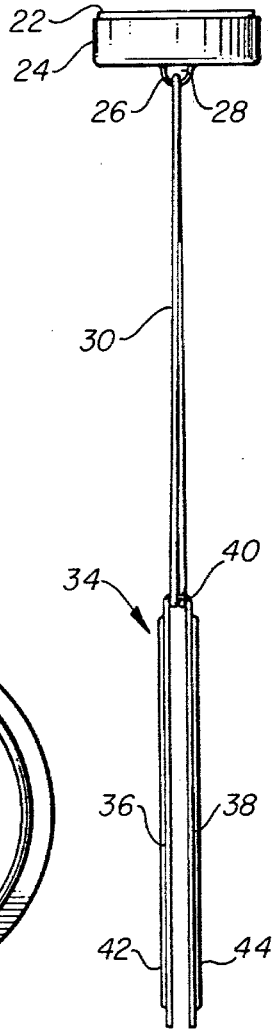
FIG. 6 is a right side elevational view thereof.
Figure 7:
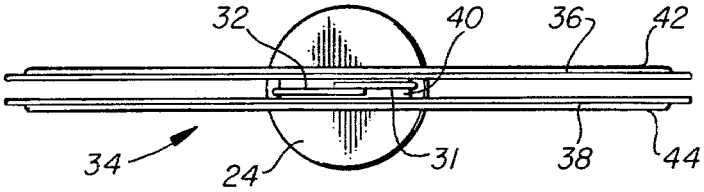
FIG. 7 is a bottom plan view thereof.
Figure 8:
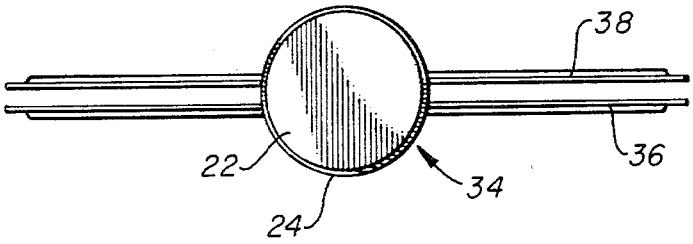
FIG. 8 is a top plan view thereof.
Figure 9:
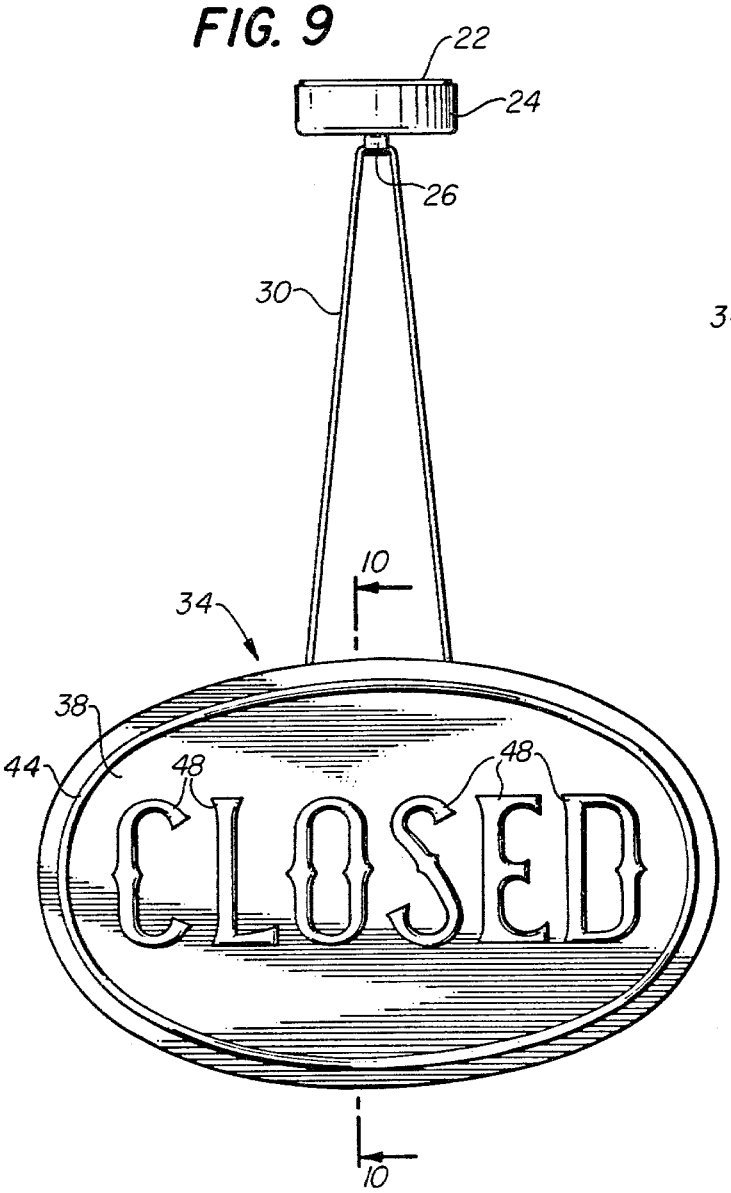
FIG. 9 is a rear elevational view thereof.
Figure 10:
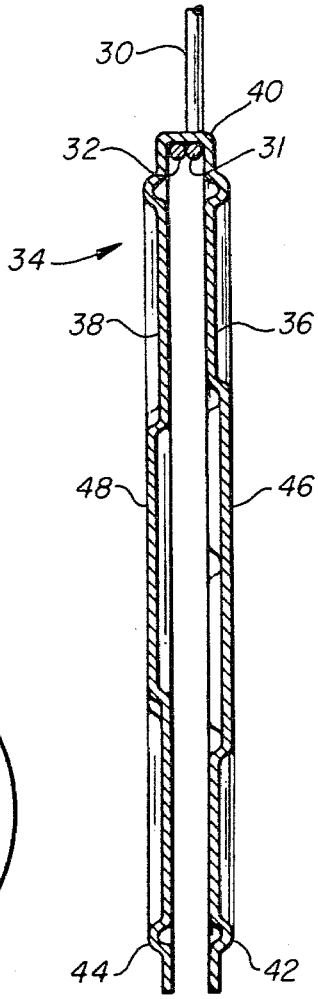
FIG. 10 is an enlarged cross-sectional view taken along line 10—10 of FIG. 9.

Referring to FIG. 1, the numeral 12 generally designates the damper position indicator secured to the lintel 14 in the upper portion of a typical fireplace opening 16.

FIG. 1 depicts a typical fireplace 18 having a screen 20 secured forward of the lintel 14.

The lintel 14 generally comprises a piece of heavy angle iron for supporting masonary above the opening 16 in the fireplace 18. It is generally constructed of a ferrous type metal such as heavy steel.

Referring to FIGS. 1–10, the damper position indicator 12 generally comprises an attachment means such as a circular magnet 22 secured within a hollow magnet holder 24. The hollow magnet holder 24 generally comprises a circular disc having deflected sides 24*a*. An attachment loop 26 is formed by stamping the metal to shear same along either side of this loop and deflecting the metal outwardly to form a passage 28 in the central portion of the magnet holder 24.

A triangular shaped hanger 30 having ends 31 and 32 joined adjacent each other in opposed parallel direction and adapted to be spread apart. The hanger is positioned through the passage 28 in attachment loop 26 such that the upper end 33 is pivotally secured within the loop 26. The connector means or hanger 30 pivotally secures a U-shaped oval sign 34 to the magnet holder 24.

As best illustrated in FIGS. 5–10, the sign 34 comprises a first side 36 and a second side 38 joined by a connector member 40 to form the U-shaped sign 34. Sides 36 and 38 are generally oval shaped such that they do not have any pointed edges. Stiffening rings 42 and 44 are formed in each of the sides 36 and 38. This provides rigidity in the length of the sign 34. It should be readily apparent that by spreading ends 31 and 32 of hanger 30 that the connector member 40 may be slideably disposed over either side of the hanger 30 and allowed to drop into a resting position on the ends 31 and 32 as the ends 31 and 32 close back together.

Indicia indicating the word "open" is stamped in raised letters 46 on the first side 36 of the sign 34.

Likewise, indicia indicating the words "closed" is stamped in raised letters 48 on the second side 38 of sign 34.

The position indicator 12 is easily attached to a ferrous metal lintel 14 by simply positioning the magnet 24 on the surface of lintel 14. The sign 34 is pivotally secured downwardly into the fireplace opening 16. The device is positioned such that the word "open" appears outwardly when the damper of the fireplace is open and is simply reversed by detaching the magnet from the lintel 14 and reattaching it to the lintel 14 such that the word "closed" is displayed when the damper is closed.

The device is pivotally secured from a hanger such that if a log or other device accidently hits the sign 34, it will pivot instead of being knocked downwardly from the lintel thereby soiling the sign or creating confusion as to whether the damper is open or closed. Further the oval shape of the signs prevents any injury to the head or hands if accidently hit.

It should be readily apparent that the invention heretofore disclosed accomplishes the objects hereinbefore discussed.

It should further be apparent that other and further embodiments of the invention may be devised without departing from the basic concept herein.

Having described my invention, I claim:

1. In a fireplace having a damper above the fireplace opening and a lintel for supporting the opening, a fireplace damper position indicator comprising: a sign with a U-shaped cross section having a first side acting as one leg of the U-shaped cross section, a second side acting as the other leg, and a connector member joining the first and second sides, said first side having indicia embossed thereon for indicating open and said second side having indicia embossed thereon for indicating closed; a wire-like hanger pivotally secured to said connector member on said sign; and magnetic connector means for pivotally securing said wire-like hanger to and downwardly of said lintel and that positions said sign in said fireplace opening.

2. The combination called for in claim 1 wherein said magnetic connector means comprises: a disk magnet having a loop secured centrally thereon to form a passage through which said wire-like hanger is secured.

3. The combination called for in claim 1 wherein said wire-like hanger comprises: a triangular shaped hanger having a pair of ends which are bent to form the base of the triangular shaped hanger and to extend in opposed directions parallel to each other, said ends adapted to be spread open to allow positioning of the sign on the hanger.

4. The combination called for in claim 1 wherein said sign comprises: oval shaped sides having a rim embossed therein to add rigidity to the sides of said sign.

5. A fireplace position damper indicator comprising: a sign with a U-shaped cross section having first oval side acting as one leg of the U-shaped cross section and second oval side acting as the other leg and a connector member joining the sides; a triangularly shaped hanger having a first narrow end thereof and a second wider end formed by two opposed ends of the wire-like hanger bent to be positioned in parallel relationship and adapted to be spread apart to allow insertion of the sign along one side of the hanger and which spring back to a central position wherein the connector member of the sign rest over the two opposed parallel ends of the hanger; and a magnetic connector having a loop formed therein and having a central passage formed therethrough adapted to receive the narrow end of said hanger so as to pivotally secure said hanger to said magnetic connector, said magnetic connector further being adapted to secure said sign downwardly of the magnetic connector within the opening of a fireplace such that it is pivotally secured.

6. The combination called for in claim 5 wherein said sign has indicia embossed on said first side to indicate open and has indicia embossed on said second side to indicate closed.

* * * * *